United States Patent [19]

Miller

[11] Patent Number: 4,830,301

[45] Date of Patent: May 16, 1989

[54] ROLLED TOILET TISSUE HOLDER AND HOUSING FOR EXTRA ROLL

[76] Inventor: Robert B. Miller, 15570 Lori Ann Lane, San Jose, Calif. 95127

[21] Appl. No.: 137,355

[22] Filed: Dec. 22, 1987

[51] Int. Cl.[4] ..... B65H 14/00

[52] U.S. Cl. ..... 242/55.3; 242/55.53

[58] Field of Search ..... 242/55.2, 55.3, 55.53

[56] References Cited

U.S. PATENT DOCUMENTS

| | | | |
|---|---|---|---|
| 2,790,608 | 4/1957 | Sieven | 242/55.3 |
| 2,872,124 | 2/1959 | Sieven | 242/55.3 |
| 4,721,264 | 1/1988 | Muscarello | 242/55.53 |

*Primary Examiner*—David Werner

*Attorney, Agent, or Firm*—John J. Leavitt

[57] ABSTRACT

Presented is an auxiliary rolled toilet tissue holder and storage device constructed as a separate unitary structure for mounting on the conventional lugs found on the conventional recessed rolled toilet tissue receptacle. The device provides a housing portion within which a recess is provided to receive the extra roll of toilet tissue. From the housing project mounting arms that pivotally lock into the conventional rolled toilet tissue receptacle lugs. The extra roll of toilet tissue is accessible by merely pivoting the housing away from the wall, permitting the extra roll to fall into one's hand.

4 Claims, 1 Drawing Sheet

ROLLED TOILET TISSUE HOLDER AND HOUSING FOR EXTRA ROLL

BACKGROUND OF THE INVENTION

1. Field of the Invention

This invention relates to toilet tissue holders, and particularly to an auxiliary rolled toilet tissue holder device that pivotally mounts on the conventional built-in rolled toilet tussue receptacle and additionally provides support for a supplementary or extra roll.

2. Description of the Prior Art

The conventional way to support rolled toilet tissue in a residential bathroom is to mount the rolled toilet tissue on a spring-pressed spindle that fits between two projecting lugs forming a part of a built-in toilet tissue receptacle. The receptacle is only sufficiently large to retain a single roll of toilet tissue, and extra rolls re frequently not available when the roll in use has been expended. To my knowledge, nobody has ever constructed or patented an auxiliary rolled toilet tissue holder which pivotally mounts in the conventional rolled toilet tissue receptacle but which provides means for mounting the rolled toilet tissue on the auxiliary device and additionally provides storage capacity for an extra or supplemental roll of toilet tissue which is easily accessible when the primary roll has been expended. Accordingly, one of the important objects of this invention is the provision of such an auxiliary rolled toilet tissue holder and storage device.

With the emphasis that has been placed in recent years on the question of decor, another object of the invention is the provision of a rolled toilet tissue holder and storage device for a supplemental roll that may be fabricated in attractive designs of multiple colors to fit any residential bathroom decor.

Still another object of the invention is the provision of an auxiliary rolled toilet tissue holder and storage device which is easy to mount on the existing conventional rolled toilet tissue receptacle, thus obviating the need for any structural changes in the bathroom.

The maintenance of sanitary conditions in the bathroom is an extremely important goal. Accordingly, another important object of the invention is the provision of an auxiliary rolled toilet tissue holder and storage device which permits the mounting for dispensing of a roll of conventional toilet tissue on the auxiliary device, but which is constructed in such a manner that the extra or supplemental roll is shielded from physical contact until such time as the primary roll has been expended, at which time the supplemental roll may be easily retrieved and mounted in dispensing position.

The invention possesses other objects and features of advantage, some of which, with the foregoing will be apparent from the following description and the drawings. It is to be understood however that the invention is not limited to the embodiment illustrated and described since it may be embodied in various forms within the scope of the appended claims.

SUMMARY OF THE INVENTION

In terms of broad inclusion, the auxiliary rolled toilet tissue holder and storage device of the invention comprises a housing adapted to be pivotally suspended from the conventional rolled toilet tissue receptacle, and includes within the housing a recess adapted to receive for storage an extra roll of toilet tissue that remains out of sight and out of contact while the primary roll of toilet tissue is also mounted on the auxiliary device for convenient and sanitary accessibility. Structurally, the housing includes a generally cylindrical portion from which extend resilient arms on the ends of which are means for mounting the arms in the conventional rolled toilet tissue holder lugs of a conventional receptacle, and which also provide means for holding the roll of toilet tissue that is accessible for use. The cylindrical portion of the housing is provided with an opening through which an extra roll of toilet tissue may be inserted into the housing and removed therefrom when the primary roll has been expended.

DESCRIPTION OF THE PREFERRED EMBODIMENT

Figure 2:
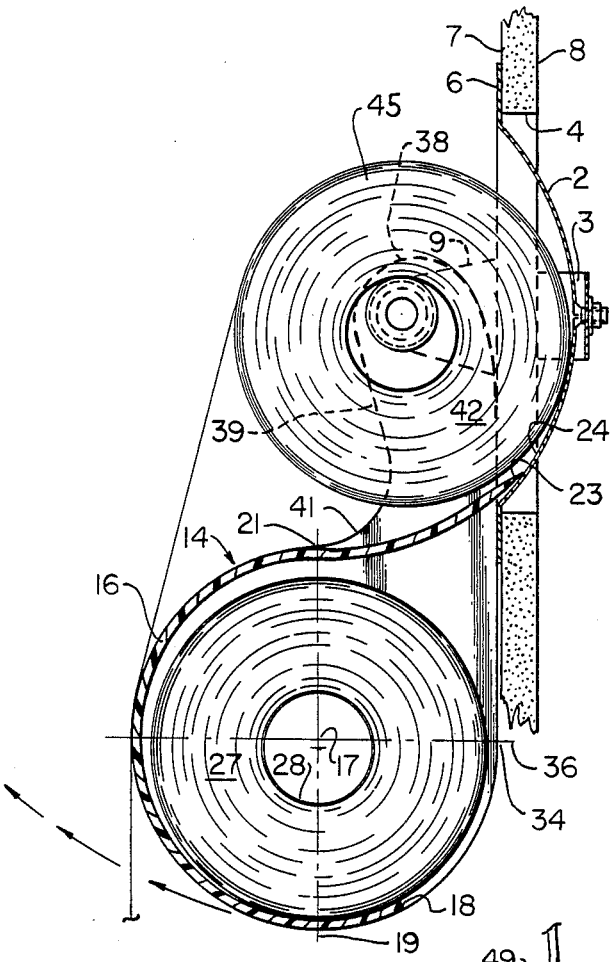
FIG. 2 is a vertical cross-sectional view taken in the plane indicated by the line 2—2 of FIG. 1.
Figure 1:
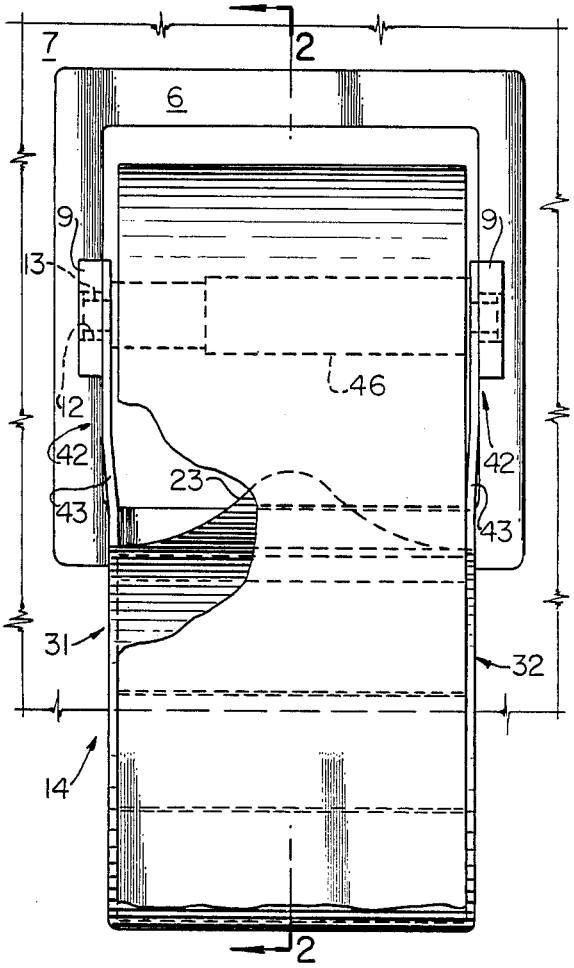
FIG. 1 is a front elevational view of the auxiliary rolled toilet tissue holder and storage device shown mounted in a conventional rolled toilet tissue receptacle.

In terms of greater detail, the auxiliary rolled toilet tissue holder and storage device of the invention comprises a structure that is auxiliary in the sense that it may be purchased as a unit and quickly and easily applied to an existing rolled toilet tissue receptacle structure that usually includes a recessed housing member 2, a bracket 3 for mounting the recessed receptacle within the aperture 4 of a conventional wall structure such as sheetrock, the receptacle 2 having projecting flanges 6 that bear against the room surface 7 of the wall structure, while the bracket 3 bears against the back surface 8 of the wall structure. Mounted on the flanges 6, on opposite sides of the opening, are a spaced pair of projecting lugs 9 having aligned apertures 12 into which the opposite end portions 13 of a conventional rolled toilet tissue spring-pressed spindle are adapted to extend to conventionally support a roll of toilet tissue in the receptacle. No claim of invention is made to this conventional structure, which is only one of many different types of structures used for this purpose.

The auxiliary rolled toilet tissue holder and storage device of the invention is adapted to be suspended from this conventional structure, and includes a housing structure designated generally by the numeral 14, the housing having a generally semi-cylindrical wall 16 developed about an axis of revolution 17, the semi-cylindrical wall commencing at a point 18 as illustrated in FIG. 2, which is displaced to the right of a vertical plane 19 that includes the axis 17 as shown. The semi-cylindrical wall 16 continues circularly about the axis 17 from the point 18 to a point 21 included in the plane 19, and from this point, the housing wall continues in a tongue portion 22 that diverges from the semi-cylindrical pattern of the wall 16, and curves upwardly to provide a tongue end that terminates at 23 in an overlapping relationship with the interior surface 24 of the conventional recessed receptacle 2.

It should be noted that the distance between the point of commencement 18 of the semi-cylindrical wall 16 and the inner surface 26 of the tongue 22 is sufficient to permit the insertion and removal of the extra roll of toilet tissue 27 which is conventionally wound on its own core 28. To enclose the semi-cylindrical housing portion thus described and illustrated, there is provided on opposite ends of the housing, a pair of end walls designated generally by the numerals 31 and 32, each of the end walls being a mirror image of the other, and each including a generally flat portion 33 which substantially conforms to the semi-cylindrical configuration of the wall 16 between the point 21 included in the plane 19, and a point 34 which is included in the plane 36 which extends horizontally and includes the axis 17, the planes 19 and 36 being perpendicular to one another. From the point 34, each of the end walls continues upwardly in an edge portion 37 adapted to abut against the flange 6 of the conventional rolled toilet tissue receptacle at the lower edge thereof, and then continues upwardly, curving outwardly from the wall surface 7 at a point substantially coincident with the base of the lugs 9 where they attach to the flange 6, and continue to form a generally circular end portion 38, which is completed by a downwardly extending edge portion 39 that merges smoothly with a curved edge portion 41 which in turn merges smoothly with the edge portion of the end wall portion that corresponds in configuration with the semi-cylindrical configuration of the wall 16. Thus, from the point 34, where the rear edge 37 of each end wall merges with the extended circular configuration that corresponds to the semi-cylindrical wall 16, each flat end wall projects upwardly to provide a mounting arm designated generally by the numeral 42, which cooperate to mount the auxiliary receptacle on the conventional lugs 9, and which also function to rotatably mount the primary roll 45 in a position of accessibility.

To support the auxiliary rolled toilet tissue holder and storage device on the lugs 9, each of the arms 42 is provided with a jogged section 43 which results in increasing the spacing between the terminal ends of the arms 42, and displaces the terminal ends of the arms 42 laterally out of the plane of the remainder 33 of each end walls. The effect of this lateral displacement is that when the arms 42 are sprung inwardly to mount the arms between the lugs 9, the arms 42 remain resiliently biased outwardly, thus aiding to retain the arms pivotally locked to the lugs 9. To effect pivotal locking of the arms 42 to the lugs 9, as previously explained, there is provided in each of the lugs an aperture 12, and each of the arms is provided with a laterally extending cylindrically tubular boss 44 adapted to rotatably engage the aperture 12. Thus, all that is required to mount the auxiliary rolled toilet tissue holder and storage device on the conventional rolled toilet tissue receptacle is that the arms 42 be squeezed toward each other and the bosses 44 aligned and engaged in the apertures 12 of the conventional lugs 9 by release of the arms.

Figure 5:
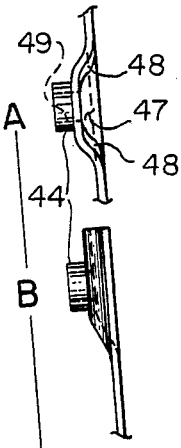
FIG. 5(A) is a fragmentary plan view of the construction of the end portion of one of the support arms of the device.
FIG. 5(B) is a side elevational view of the fragmentary structure illustrated in FIG. 5(A).
Figure 4:
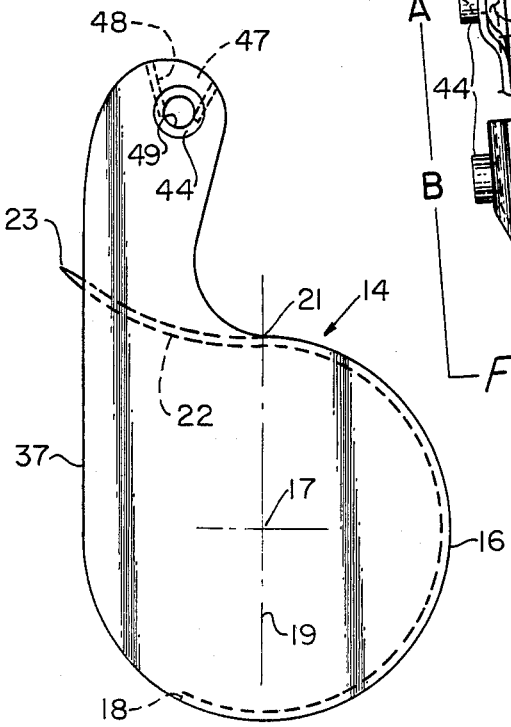
FIG. 4 is a side elevational view of the structure as illustrated in FIG. 3.
Figure 3:
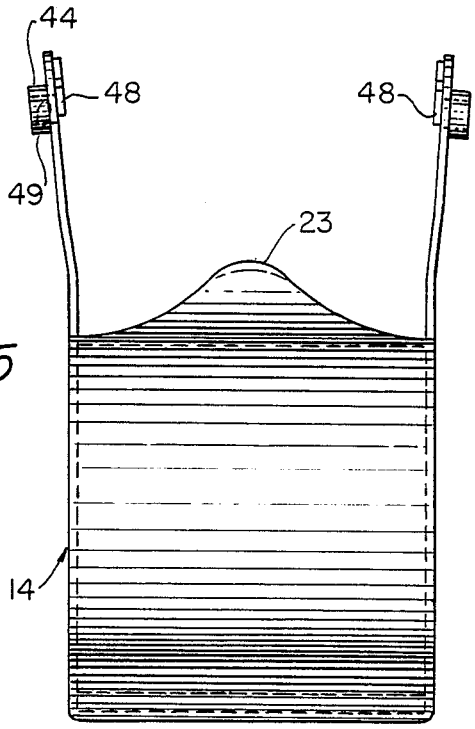
FIG. 3 is a front elevational view of the device shown apart from any other structure.

Since mounting of the auxiliary rolled toilet tissue holder on the conventional lugs 9 now occupies the structure by which a conventional roll of toilet tissue would be supported in the receptacle, it is necessary that the auxiliary rolled toilet tissue holder and storage device provide additional means by which the conventional spindle 46 that is conventionally used to support a roll of toilet tissue may be accommodated. Accordingly, there is provided associated with the terminal ends 38 of the arms 42 a channel 47 having side walls 48 that converge from the outer edge of the arms to the inner periphery 49 of the bosses 44, thus providing a guide means by which the bosses 13 formed on the spring-pressed spindle 46 that supports the primary roll of toilet tissue 43 may be inserted into the apertures formed in the bosses 44. In FIG. 3, the walls 48 are formed by ribs formed on the inner surface of the arms 42, while in FIGS. 5(A) and 5(B) the channel 47' is formed by a recess formed in the material from which the arm 42 is formed, which may conveniently be a suitable synthetic resinous material.

It will thus be seen that with the device mounted on the conventional rolled toilet tissue dispenser lugs 9, a primary roll of toilet tissue 45 may be mounted for accessibility between the arms 42 in a position above the storage housing 14, with an extra or supplementary roll of toilet tissue 27 being enclosed within the housing as illustrated. When the primary roll has been expended, all that is required is that the housing be swung to the left as indicated by the arrows in FIG. 2, i.e., swung away from the wall, so that the opening in the housing formed between the point 18 where the semi-cylindrical wall 16 terminates and the inner surface 26 of the tongue 22 will be facing downwardly, thus permitting gravity to cause the extra roll 27 of toilet tissue to drop through the opening into one's hand. The extra roll of toilet tissue may now be mounted in the primary position for accessibility. It will of course be understood that in the attitude of the device illustrated in FIG. 2, the projection of the cylindrical wall 16 past the plane 19 retains the extra roll of toilet tissue within the recess formed by the housing. It should also be understood that while I have illustrated and described only one recess for acceptance of only one extra roll of toilet tissue, it is within the scope of the invention to elongate the housing to accommodate two or more extra rolls of toilet tissue. In like manner, while I have illustrated and described a conventional toilet tissue receptacle that is mounted in a wall aperture and includes a recess, the invention is applicable with conventional toilet tissue support structures that project perpendicularly from a flat wall.

Having thus described the invention, what is believed to be new and novel and sought to be protected by Letters Patent of the United States is as follows:

I claim:

1. An auxiliary rolled toilet tissue holder and storage device for holding a first roll of toilet tissue in position of accessibility and for storing at least one additional roll of toilet tissue in position for ready accessibility when said first roll of toilet tissue is expended, comprising:

(a) a housing including a recess adapted to receive for storage said at least one additional roll of toilet tissue;

(b) a pair of resiliently flexible arms integral with and extending from said housing and having free end portions laterally spaced apart;

(c) means on the free end portions of said resiliently flexible arms operative to selectively pivotally suspend said housing on a conventional rolled toilet tissue mounting structure; and (d) means on the free end portions of said resiliently flexible arms operative to receive and rotatably support a conventional toilet tissue roll spindle on which said first roll of toilet tissue is supported in position of accessibility.

2. The combination according to claim 1, in which said means on the free end portions of said resiliently flexible arms operative to receive a conventional toilet tissue roll spindle comprises opposed channels adapted to guide said spindle into mounted position on the free end portions of said resiliently flexible arms.

3. The combination according to claim 1, in which said means on the free end portions of said resiliently flexible arms operative to selectively pivotally suspend said housing and rotatably support said spindle comprise oppositely projecting axially aligned apertured bosses integrally formed on said flexible arms.

4. An auxiliary rolled toilet tissue holder and storage device for holding a first roll of toilet tissue in position of accessibility and for storing a second roll of toilet tissue in position for ready accessibility when said first roll of toilet tissue is expended, comprising:

(a) a housing including a recess adapted to receive for storage said second roll of toilet tissue;

(b) a pair of resiliently flexible arms extending from said housing and having free end portions laterally spaced apart;

(c) means on the free end portions of said resiliently flexible arms operative to selectively pivotally suspend said housing on a conventional rolled toilet tissue mounting structure;

(d) means on the free end portions of said resiliently flexible arms operative to receive a conventional toilet tissue roll spindle on which said first roll of toilet tissue is supported in position of accessibility; and (e) means projecting from said housing portion and between said resiliently flexible arms whereby toilet tissue may be dispensed from the backside of said first roll and guided over the outside of said housing for ready accessibility.

* * * * *